US008205364B2

(12) United States Patent
Shimosaka et al.

(10) Patent No.: US 8,205,364 B2
(45) Date of Patent: Jun. 26, 2012

(54) IRON

(75) Inventors: Kiichi Shimosaka, Shiga (JP); Yasuharu Otsuka, Kyoto (JP)

(73) Assignee: Panasonic Corporation, Osaka (JP)

( * ) Notice: Subject to any disclaimer, the term of this patent is extended or adjusted under 35 U.S.C. 154(b) by 288 days.

(21) Appl. No.: 12/718,079

(22) Filed: Mar. 5, 2010

(65) Prior Publication Data

US 2010/0242315 A1 Sep. 30, 2010

(30) Foreign Application Priority Data

Mar. 24, 2009 (JP) ..... 2009-071314

(51) Int. Cl.
*D06F 75/40* (2006.01)
*D06F 79/00* (2006.01)

(52) U.S. Cl. ..... 38/79

(58) Field of Classification Search ..... 219/245, 219/259; D32/68–71; 38/77.8, 79, 88–97
See application file for complete search history.

(56) References Cited

U.S. PATENT DOCUMENTS

| | | | | | |
|---|---|---|---|---|---|
| 1,870,200 | A | * | 8/1932 | Curtiss | 38/79 |
| 2,140,852 | A | * | 12/1938 | Perry | 38/79 |
| D128,666 | S | * | 8/1941 | Huffman | D32/70 |
| 2,321,509 | A | * | 6/1943 | Olving | 38/79 |
| 2,368,048 | A | * | 1/1945 | Seymour Stone | 38/77.8 |
| 2,624,136 | A | * | 1/1953 | Wilson | 38/79 |
| 2,632,969 | A | * | 3/1953 | Gerber | 38/79 |
| 2,660,820 | A | * | 12/1953 | Wilson | 38/79 |
| 3,593,442 | A | * | 7/1971 | Davidson et al. | 38/79 |
| 4,115,935 | A | * | 9/1978 | Toft | 38/88 |
| 5,390,433 | A | * | 2/1995 | Brady | 38/79 |
| 5,732,489 | A | * | 3/1998 | Udelle et al. | 38/94 |

FOREIGN PATENT DOCUMENTS

| | | |
|---|---|---|
| JP | 2-4760 | 5/1927 |
| JP | 371615 | 11/1949 |
| JP | 47-47557 | 11/1972 |
| JP | 2009-028385 | 2/2009 |
| WO | 03/085189 | 10/2003 |

OTHER PUBLICATIONS

Japanese Office Action, with English Translation, issued in Japanese Patent Application No. 2009-071314 dated Dec. 27, 2011.

* cited by examiner

*Primary Examiner* — Ismael Izaguirre
(74) *Attorney, Agent, or Firm* — Panasonic Patent Center; Dhiren Odedra; Kerry Culpepper

(57) ABSTRACT

Provided is an iron which enables ironing to be performed efficiently through both forward and backward movements of the iron and which provides improved usability thereof when moved backward in the direction of a rear end portion of a soleplate. A support is provided for supporting an iron main body to be in a self-standing state where the soleplate, which has the front and rear end portions each formed in a pointed shape, is substantially vertically disposed. The support has first and second support portions that are provided to both sides of the rear end portion so as to protrude backward from the iron main body, and has a third support portion provided at a rear portion of a grip part. A space that allows the rear end portion of the soleplate to be visible is provided between the first and second support portions.

12 Claims, 10 Drawing Sheets

IRON

BACKGROUND

1. Technical Field

The technical field relates to an iron for ironing out wrinkles from clothes or the like.

2. Description of the Background Art

The soleplate of conventional irons of the above type has a pointed tip. With such an iron, ironing can be performed in the following manner: run the iron over clothes to press and smooth out the clothes in the ironing direction, thereby ironing out the wrinkles thereof. Also, such an iron facilitates delicate ironing work around buttons of the clothes. Since ironing work is performed using limited space on an ironing board, the iron is repeatedly moved forward and backward over the clothes in a reciprocating manner, and also, the form of the clothes is adjusted during the ironing work. Generally speaking, the rear portion of the soleplate of an iron does not have a pointed shape. Accordingly, while the iron is being moved backward, pressing force is not applied to the iron and the rear portion of the soleplate is slightly raised from the clothes. In this manner, an erroneous operation of the iron, which causes creases to be formed on the clothes, can be prevented.

However, during ironing, such erroneous operation is often performed since wrinkles of the clothes can be efficiently ironed out by moving the iron in a reciprocating manner. Creases formed by ironing are hard to remove. Therefore, as shown in FIG. 10, it is conceived that a rear end portion 102 of a soleplate 101 is formed to have a similar pointed shape to that of a tip portion 103 (see, e.g., Japanese Laid-Open Patent Publication No. 2009-28385 (hereinafter, referred to as Patent Document 1)).

The rear end portion 102 of the soleplate 101 of the iron described in Patent Document 1 is formed to have a pointed shape for the purpose of preventing creases from being formed when the iron is moved backward. However, a handle body 104 overhangs the pointed rear end portion 102. For this reason, there is a problem that while the iron is being moved backward over clothes, a part of the clothes near the pointed rear end portion 102 cannot be seen.

In general, ironing work includes an action to move an iron over clothes to iron out wrinkles thereof and an action to adjust the form of the clothes. Ironing is performed by repeating these actions to iron out the wrinkles and adjust the form of the clothes. In the case of a cordless iron described in Patent Document 1, the iron is placed on a stand during a break in use of the iron, while the form of the clothes is adjusted.

When the iron is placed on the stand, power is supplied to a heating element of the iron. A connection terminal 105 for the power supply is provided near and above the rear end portion 102 of the soleplate 101. Accordingly, for the rear end portion 102 of the soleplate 101, it is difficult to obtain the same level of visibility as that of the tip portion 103. While the iron is being moved backward, sight of an area neighboring and encompassing the pointed rear end portion 102 is blocked by the handle body 104, and accordingly, the area neighboring and encompassing the pointed rear end portion 102 cannot be viewed. Thus, only forming the rear end portion 102 of the soleplate 101 into a pointed shape does not solve the problem that when the iron is moved backward, creases are formed due to an erroneous operation of the iron.

SUMMARY

In view of the above-mentioned problem, as well as other concerns, a concern of the present disclosure is to: obtain visibility of the rear end portion of the soleplate during ironing; enable ironing to be efficiently performed through both forward and backward movements of an iron; and provide improved usability of an iron when the iron is moved backward in the direction of the rear end portion that has a pointed shape.

Accordingly, an iron according to a first aspect includes: a base heated by a heating element; a soleplate provided on a bottom surface of the base, the soleplate having a front end portion and a rear end portion that are each formed in a pointed shape; a thermal insulation board covering a top surface of the base; a handle body provided above the thermal insulation board and having a grip part; and a support for supporting an iron main body to be in a self-standing state where the soleplate is substantially vertically disposed. The support has a first support portion and a second support portion that are provided to both sides of the rear end portion of the soleplate so as to protrude backward from the iron main body, and has a third support portion provided at a rear portion of the grip part. A space that allows the rear end portion of the soleplate to be visible is formed between the first and second support portions.

Accordingly, visibility of the rear end portion of the soleplate can be obtained while the iron is being moved backward during ironing, and ironing can be performed efficiently through both forward and backward movements of the iron, that is, through an action to move the iron forward in the direction of the front end portion and an action to move the iron backward in the direction of the rear end portion. Also, usability of the iron when the iron is moved backward in the direction of the rear end portion is improved.

In an iron according to a second aspect, when the iron main body is supported by the support as set in the self-standing state, the rear end portion of the soleplate can be located in a position that is distanced upward, by a predetermined distance, from a setting surface on which the iron main body is set.

Accordingly, when the iron is set on the setting surface, risk of the setting surface becoming overheated due to heat of the soleplate that is heated at a high temperature can be reduced. Thus, the iron can be set safely on the setting surface.

In an iron according to a third aspect, the first and second support portions protrude further backward than the rear end portion of the soleplate.

Accordingly, overheating of the setting surface can be prevented when the iron is set on the setting surface.

In an iron according to a fourth aspect based on any one of the first to third aspects, the first and second support portions are both distanced laterally from the rear end portion of the soleplate by respective distances that are set to be substantially equal to each other.

Accordingly, favorable visibility of an area neighboring and encompassing the rear end portion can be obtained while the iron is being moved backward. Also, regardless as to whether a left or a right hand operates the iron, a visible area can be obtained equally.

In an iron according to a fifth aspect based on any one of the first to third aspects, the first and second support portions are provided at both ends of a support forming body that is formed in a substantially U-shaped configuration along an outer side surface of the thermal insulation board.

Accordingly, in addition to obtaining favorable visibility of the pointed tip of the rear end portion of the soleplate, visibility of the outer periphery of the soleplate and visibility of the pointed tip of the front end portion can be improved. Also, by attaching the support forming body to the iron main body, the support for supporting the iron main body to be in a self-standing state can be readily formed.

In a sixth aspect based on the fifth aspect, the iron further includes: a vaporizing chamber, formed on the base, for generating steam; and a water tank, arranged above the thermal insulation board, for storing water to be supplied to the vaporizing chamber. The support forming body covers a gap between the water tank and the thermal insulation board.

Accordingly, heat from the soleplate, which ascends along the outer wall of the thermal insulation board, can be prevented from entering between the thermal insulation board and the water tank. In this manner, deterioration of the water tank due to the heat can be prevented.

In a seventh aspect based on any one of the first to third aspects, the first and second support portions are formed as rod-like bodies that protrude backward from the iron main body such that when the iron main body is in a self-standing state, the soleplate is distanced upward from a setting surface, on which the iron main body is set, so as to have a predetermined height from the setting surface. A first space is formed between the first and second support portions that are the rod-like bodies. A second space is formed between the first support portion, the second support portion, and a third support portion provided at the rear portion of the grip part.

Accordingly, the spaces are readily formed by the support that supports the iron main body to be in a self-standing state. By setting a horizontal interval between the rod-like bodies to be an appropriate interval, the iron main body can be supported stably when set in a self-standing state, and also, a wide viewing angle, within which an area neighboring and encompassing the rear end portion is visible, can be obtained. Accordingly, visibility of the neighboring and encompassing area can be obtained based on movement of the iron.

In an iron according to an eighth aspect based on any one of the first to third aspects, the iron further includes:

a terminal embedded within a rear portion of the handle body; and a handle backing plate covering the terminal. A central portion of the handle backing plate is recessed forward to form a third space.

Accordingly, the area neighboring and encompassing the rear end portion, which is visible while the iron is being moved backward, can be expanded. Thus, the visibility of the neighboring and encompassing area can be obtained based on movement of the iron.

In a ninth aspect based on any one of the first to third aspects, a rear portion of the handle body protrudes backward to form the first and second support portions.

Accordingly, visibility of the rear end portion of the soleplate can be obtained while the iron is being moved backward during ironing, and the iron main body can be stably supported in a self-standing state by a simple and robust structure.

In a tenth aspect based on any one of the first to eighth aspects, a rear portion of the thermal insulation board protrudes backward to form the first and second support portions.

Accordingly, visibility of the rear end portion of the soleplate can be obtained while the iron is being moved backward during ironing, and the iron main body can be stably supported in a self-standing state by a simple and robust structure.

These and other objects, features, aspects and advantages of the an iron according to various embodiments will become more apparent from the following detailed description of the when taken in conjunction with the accompanying drawings.

DESCRIPTION OF THE PREFERRED EMBODIMENTS

Hereinafter, an iron according to various exemplary will be described with reference to the accompanying drawings. Note that the iron is not limited to these embodiments.

First Embodiment

Figure 1:
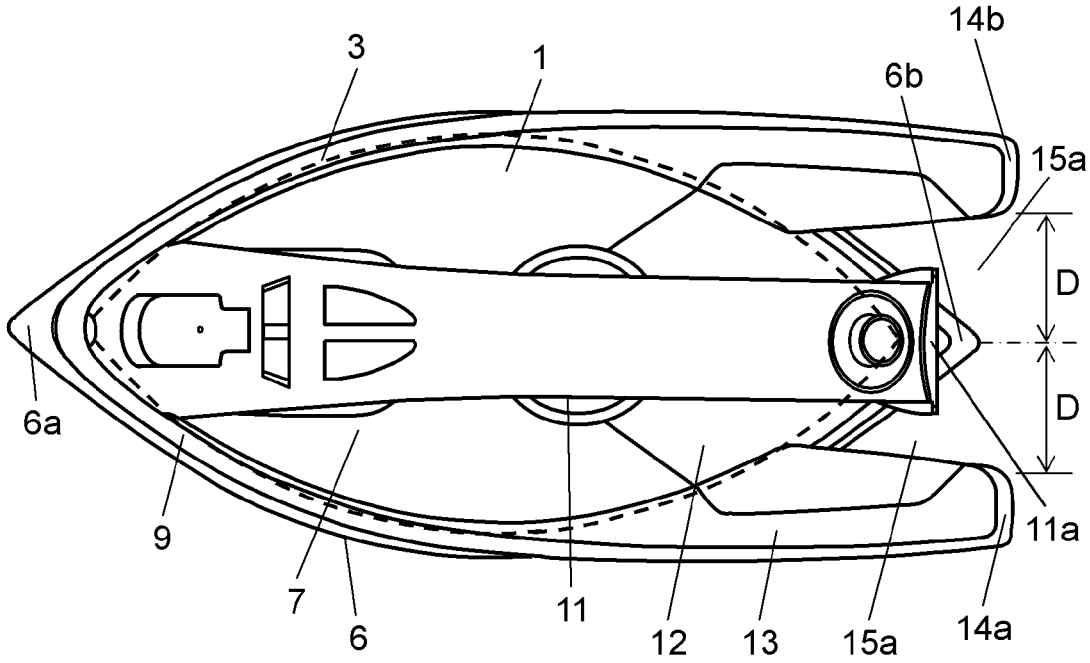
FIG. 1 is a top view of an iron according to a first embodiment.
Figure 2:
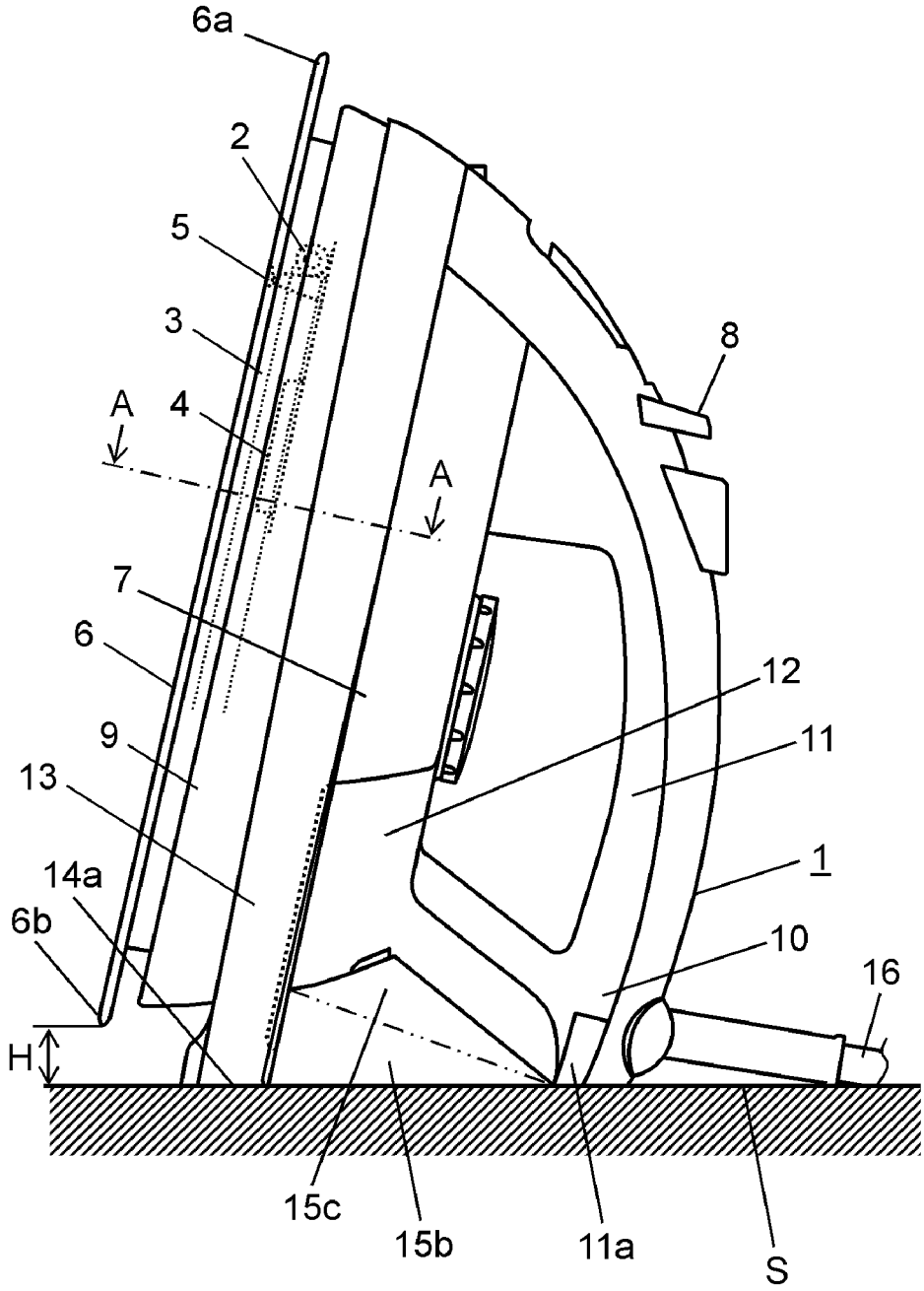
FIG. 2 is a side view showing the iron in a self-standing state.
Figure 3:
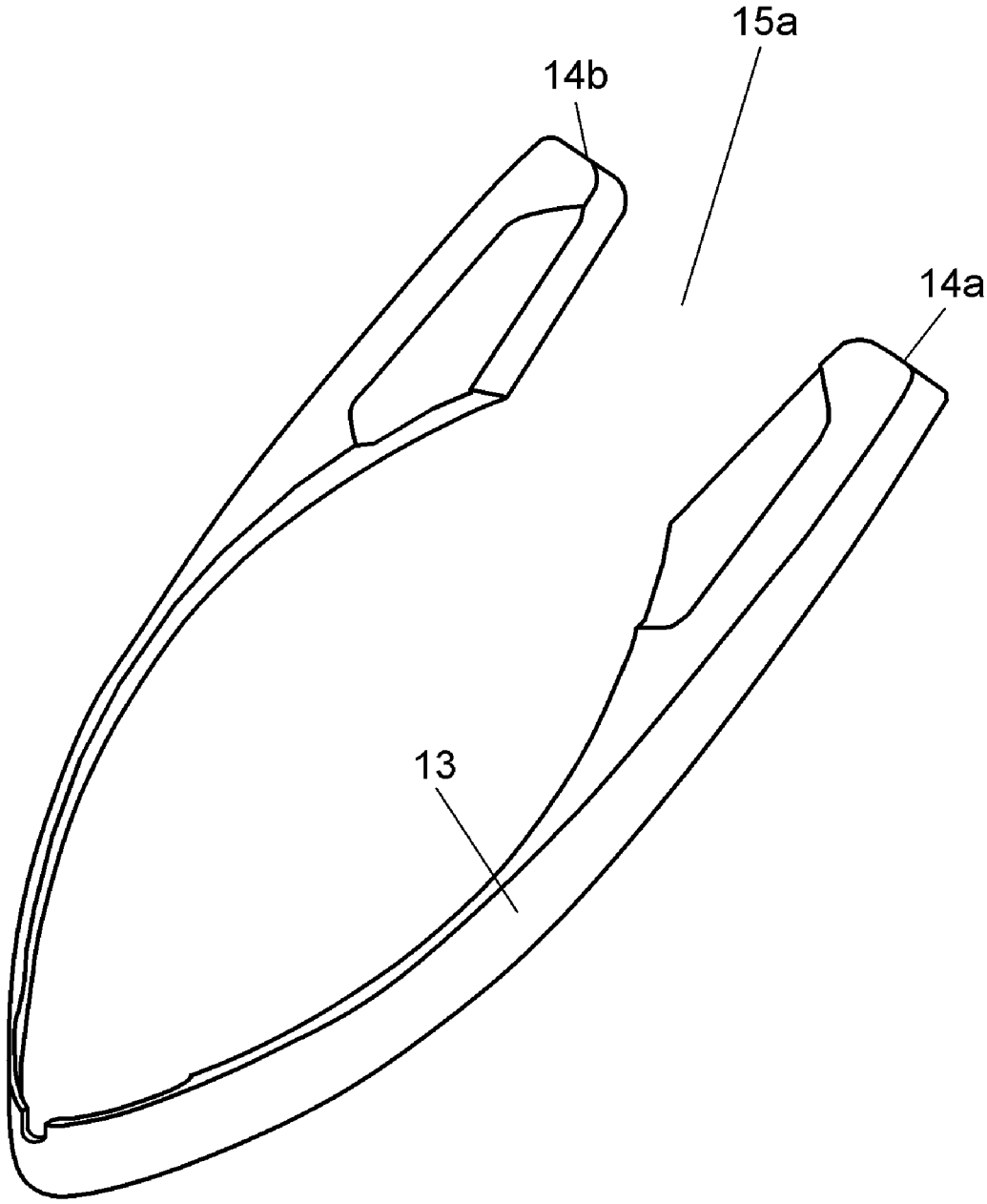
FIG. 3 is a perspective view of a support forming body of the iron.
Figure 4:
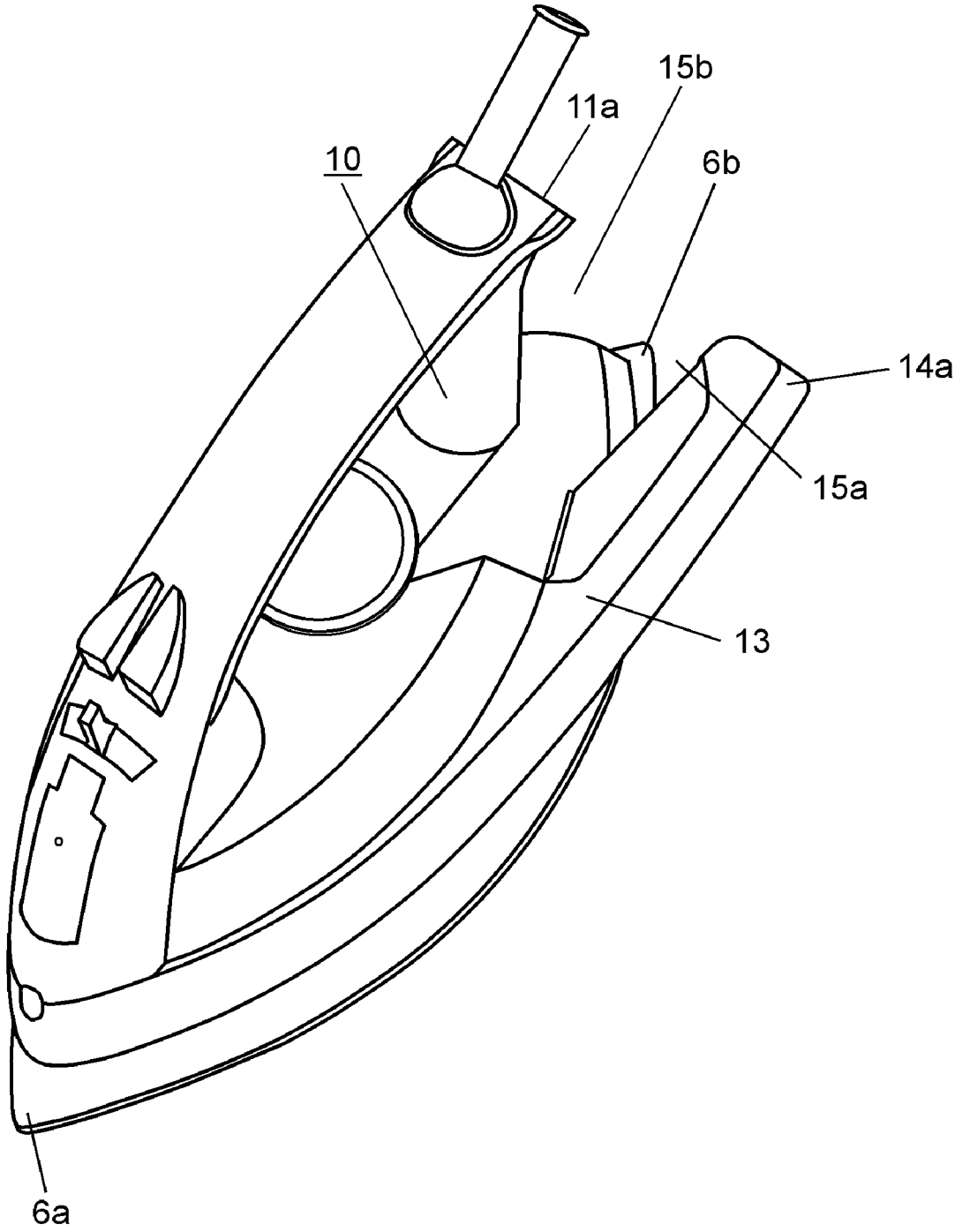
FIG. 4 is a perspective view of the iron.
Figure 5:
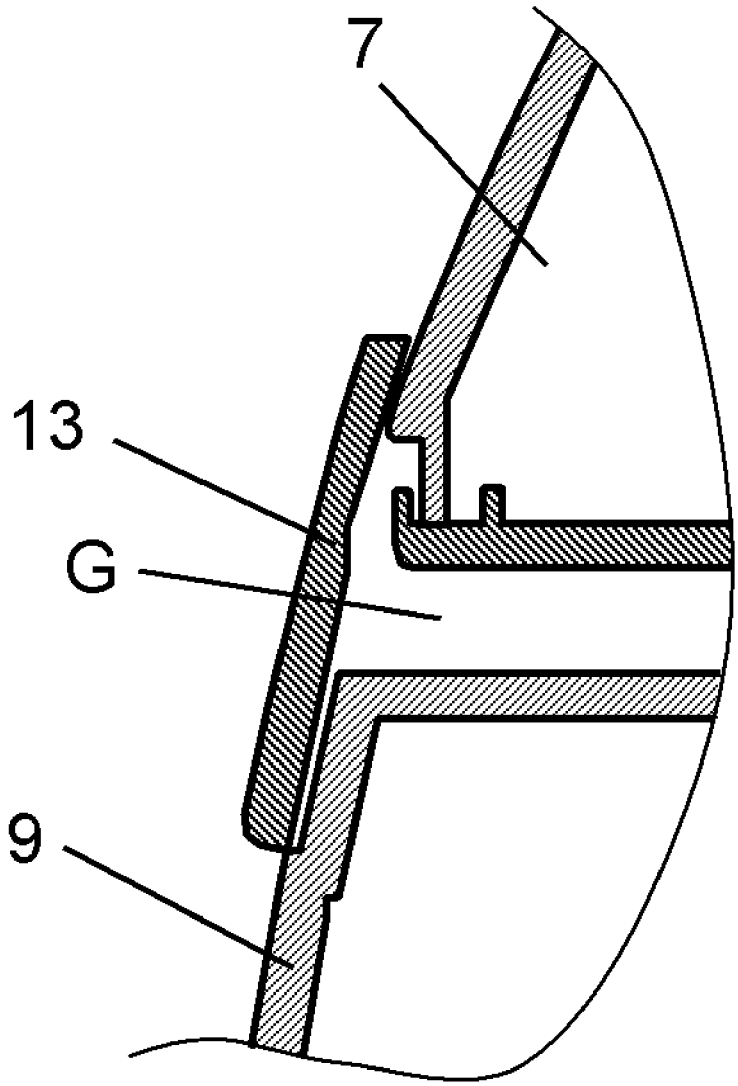
FIG. 5 is a cross-sectional view of the iron cut along line A-A shown in FIG. 2.
Figure 6:
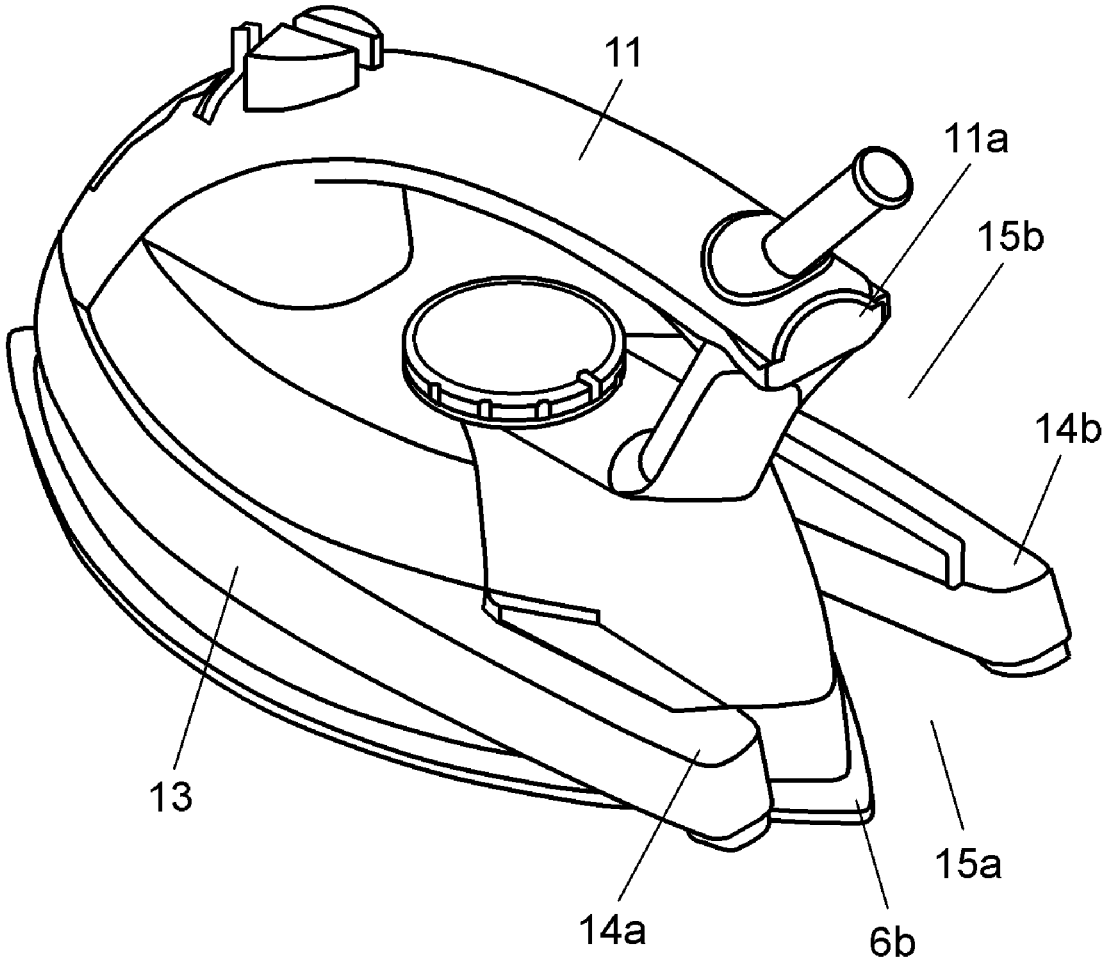
FIG. 6 is a perspective view of the iron.

FIG. 1 is a top view of an iron according to a first embodiment. FIG. 2 is a side view showing the iron in a self-standing state. FIG. 3 is a perspective view of a support forming body of the iron. FIG. 4 is a perspective view of the iron. FIG. 5 is a cross-sectional view of an essential part of the iron. FIG. 6 is a perspective view of the iron.

As shown in FIGS. 1 to 6, an iron main body 1 includes: a base 3 that is heated by an embedded heating element 2; a vaporizing chamber 4, formed as a recession on a top surface of the base 3, for generating steam; and a steam hole 5, formed in a bottom surface of the base 3, for discharging the steam generated in the vaporizing chamber 4. Also, the iron main body 1 has a soleplate 6 that includes a front end portion **6*a* and a rear end portion 6*b* of the base 3**, which are each formed in a pointed shape.

A resin water tank 7 stores water to be supplied to the vaporizing chamber 4. Through external operation of a steam dial 8 by a user, the water in the water tank 7 is supplied to the vaporizing chamber 4, or the water supply to the vaporizing chamber 4 is ceased. A thermal insulation board 9 is provided so as to cover the top surface of the base 3. A resin handle body 10 is arranged above the thermal insulation board 9 so as to form a grip part 11.

A handle backing plate 12 is provided between the thermal insulation board 9 and the handle body 10. The handle backing plate 12 is configured to cover, from the back, a terminal (not shown) that is formed within a rear portion of the handle body 10. Connected to the terminal are: a power cord 16 extending from a rear portion of the grip part 11; and a circuit of the heating element 2.

A support forming body 13 is formed, in a substantially U-shaped configuration, along the outer side surfaces of the water tank 7 and the thermal insulation board 9. At both ends of the support forming body 13, a first support portion **14*a* and a second support portion 14*b* are provided, respectively. The first support portion 14*a* and the second support portion 14*b* contact a setting surface S when supporting the iron main body 1 to be in a self-standing state where the soleplate 6 is substantially vertically disposed. To both sides of the rear end portion 6*b*, the first support portion 14*a* and the second support portion 14*b* that are rod-like bodies protrude backward from the iron main body 1 such that when the iron main body 1 is in a self-standing state, the soleplate 6** is distanced upward from the setting surface S so as to have a predetermined height H therefrom.

A third support portion 11*a* is provided at the rear portion of the grip part 11. The iron main body 1 is supported at three points, i.e., the first support portion 14*a*, the second support portion 14*b* and the third support portion 11*a*, so as to be in a self-standing state. When the iron main body 1 is supported to be in a self-standing state, the front end portion 6*a* of the soleplate 6 of the base 3 molded from aluminum alloy is in a state of being inclined toward the handle body 10 side. In this manner, the center of gravity of the iron main body 1 is balanced, and thus the iron main body 1 can be set stably.

Formed between the first support portion 14*a* and the second support portion 14*b* is a first space 15*a* that is an open space that allows, while a user holding the grip part 11 is moving the iron main body 1 backward, the user to view an area neighboring and encompassing the rear end portion 6*b* of the soleplate 6.

Also, formed between the first support portion 14*a*, the second support portion 14*b*, and the third support portion 11*a* is a second space 15*b* that is an open space. Further, a central portion of the handle backing plate 12 is recessed forward, whereby a third space 15*c* is formed. As a result, while the iron main body 1 is being moved backward, a wide viewing angle, within which an area neighboring and encompassing the rear end portion 6*b* of the soleplate 6 is visible, can be obtained. Accordingly, visibility of the neighboring and encompassing area can be obtained based on movement of the iron.

The first support portion 14*a*, the second support portion 14*b*, and the third support portion 11*a* form a support for supporting the iron main body 1 to be in a self-standing state. When the iron main body 1 is set by means of the support to be in a self-standing state, the rear end portion 6*b* of the soleplate 6 is located in a position that is distanced upward, by the predetermined height H, from the setting surface S on which the iron main body 1 is set.

The first support portion 14*a* and the second support portion 14*b*, which are rod-like bodies protruding backward from the iron main body 1, protrude further backward than the rear end portion 6*b*. Also, the first support portion 14*a* and the second support portion 14*b* are both distanced laterally from the rear end portion 6*b* by respective distances D that are set to be substantially equal to each other.

The support forming body 13 is formed in a substantially U-shaped configuration along the outer side surfaces of the water tank 7 and the thermal insulation board 9, so as to cover, from the outside, a gap G that is formed between the top of the thermal insulation board 9 and the bottom of the water tank 7. In this manner, the gap is shielded.

Actions of, and functions provided by, the iron having the above configuration will be described below. First, when the steam dial 8 is operated and the water in the water tank 7 is supplied to the vaporizing chamber 4, steam is generated in the vaporizing chamber 4 heated by the heating element 2. The steam is discharged to the outside through the steam hole 5. As a result, the steam can be applied to clothes or the like while ironing is being performed thereon.

Here, after moving the iron forward so as to press and smooth out the clothes with the front end portion 6*a*, viewing an area neighboring and encompassing the front end portion 6*a* of the soleplate 6, the user moves the iron backward toward the rear end portion 6*b* side for reciprocating ironing movement. At the time, the user holding the grip part 11 can view, through the first space 15*a* and the second space 15*b*, the condition of a part of the clothes in an area neighboring and encompassing the rear end portion 6*b*. Accordingly, a direction in which to hold the grip part 11 does not have to be changed to a backward direction in which the rear end portion 6*b* is moved. Also, there is no need to switch the hand holding the grip part 11 to the other hand when moving the iron backward. As a result, an erroneous operation of the iron, which causes creases to be formed on the clothes, can be prevented.

Thus, without having to change the manner of holding the grip part 11 to change the moving direction of the iron, the user can efficiently perform ironing through reciprocating ironing actions, that is, an action to move the iron forward in the direction of the front end portion 6*a* and an action to move the iron backward in the direction of the rear end portion 6*b*. Also, favorable visibility can be obtained while the iron is being moved backward in the direction of the rear end portion 6*b*. This improves usability of the iron.

When the iron main body 1 is set by means of the support to be in a self-standing state, the rear end portion 6*b* of the soleplate 6 is located in a position that is distanced upward, by the predetermined height H, from the setting surface S on which the iron main body 1 is set. As a result, when the iron is set on the setting surface S, there is no fear that the setting surface S becomes overheated due to heat of the soleplate 6 that is heated at a high temperature. Thus, the iron can be set safely on the setting surface S.

The first support portion 14*a* and the second support portion 14*b* protrude further backward than the rear end portion 6*b* of the soleplate 6. For this reason, when the iron is set on the setting surface S, the rear end portion 6*b* of the soleplate 6 can be distanced upward from the setting surface S. Accordingly, overheating of the setting surface S can be prevented.

Further, the first support portion 14*a* and the second support portion 14*b* are distanced laterally from the rear end portion 6*b* of the soleplate 6 by the respective distances D that are set to be substantially equal to each other. Accordingly, favorable visibility of an area neighboring and encompassing the rear end portion 6*b* can be obtained while the iron is being moved backward. Also, regardless as to whether a left or a right hand operates the iron, a visible area can be obtained equally.

Still further, the first support portion 14*a* and the second support portion 14*b* are provided at both the ends of the support forming body 13 that is formed in a substantially U-shaped configuration along the outer side surface of the thermal insulation board 9. Accordingly, in addition to the visibility of the pointed tip of the rear end portion 6*b* of the soleplate 6, visibility of the outer periphery of the soleplate 6 and visibility of the pointed tip of the front end portion 6*a* can be improved. Still further, by attaching the support forming body 13 to the iron main body 1, the support for supporting the iron main body 1 to be in a self-standing state can be readily formed.

Still further, the iron main body 1 includes: the vaporizing chamber 4, formed on the base 3, for generating steam; and the water tank 7, arranged above the thermal insulation board 9, for storing water to be supplied to the vaporizing chamber 4. The gap G between the water tank 7 and the thermal insulation board 9 is covered by the support forming body 13. Accordingly, heat from the soleplate 6, which ascends along the outer wall of the thermal insulation board 9, can be prevented from entering between the thermal insulation board 9 and the water tank 7. In this manner, deterioration of the water tank 7 due to the heat can be prevented.

Still further, the first support portion 14*a* and the second support portion 14*b* are formed as rod-like bodies that protrude backward from the iron main body 1 such that when the iron main body 1 is in a self-standing state, the soleplate 6 is distanced upward from the setting surface S so as to have the predetermined height H therefrom. The first space 15*a* is formed between the first support portion 14*a* and the second support portion 14*b* that are the rod-like bodies. Also, the second space 15*b* is formed between the first support portion 14*a*, the second support portion 14*b*, and the third support portion 11*a* provided at the rear portion of the grip part 11. In this manner, the spaces are readily formed by the support that supports the iron main body 1 to be in a self-standing state. By setting a horizontal interval between the rod-like bodies to be an appropriate interval, the iron main body 1 can be supported stably when set in a self-standing state, and also, a wide viewing angle, within which an area neighboring and encompassing the rear end portion 6*b* is visible, can be obtained. Accordingly, visibility of the neighboring and encompassing area can be obtained based on movement of the iron.

Still further, the terminal is embedded within the rear portion of the handle body 10. The iron main body 1 includes the handle backing plate 12 that covers the terminal. The central portion, in the up-down and left-right directions, of the handle backing plate 12 is recessed forward, whereby the third space 15*c* is formed. Accordingly, the area neighboring and encompassing the rear end portion 6*b*, which is visible while the iron is being moved backward, can be expanded. Thus, the visibility of the neighboring and encompassing area can be obtained based on movement of the iron.

Still further, as a result of forming the first support portion 14*a* and the second support portion 14*b* by protruding the rear portion of the handle body 10 backward, visibility of the rear end portion 6*b* of the soleplate 6 can be obtained while the iron is being moved backward during ironing, and the iron main body 1 can be stably supported in a self-standing state by a simple and robust structure.

As described above, the first space 15*a* is formed between the first support portion 14*a* and the second support portion 14*b*. This allows favorable visibility of an area neighboring and encompassing the rear end portion 6*b* to be obtained while the iron is being moved backward in the direction of the rear end portion 6*b*. To be specific, the user can view the area neighboring and encompassing the rear end portion 6*b* through the first space 15*a* when having moved the iron forward in the direction of the front end portion 6*a*, for example, to the left side of the user so as to press and smooth out clothes with the front end portion 6*a* of the soleplate 6. Then, the user can move the iron backward in the direction of the rear end portion 6*b*, i.e., toward the right side of the user, viewing the condition of the clothes.

As the iron approaches in front of the user, it becomes difficult for the user to view the area neighboring and encompassing the rear end portion 6*b*. In this manner, the visibility changes depending on the position of the iron. Accordingly, as a result of forming the first space 15*a*, when ironing is performed so as to move the iron forward and backward within a range that allows the visibility of the area neighboring and encompassing the rear end portion 6*b* to be obtained, the necessity to switch the forward moving direction of the iron and to switch the hand holding the grip part 11 is eliminated. This provides improved usability of the iron.

In addition to the first space 15*a*, by forming the second space 15*b* between the first support portion 14*a*, the second support portion 14*b*, and the third support portion 11*a* provided at the rear portion of the grip part 11, the area neighboring and encompassing the rear end portion 6*b*, which is visible while the iron is being moved backward in the direction of the rear end portion 6*b*, i.e., toward the right side of the user, can be expanded. Accordingly, even when the iron is passed in front of the user, the area neighboring and encompassing the rear end portion 6*b* is visible through the second space 15*b*. Therefore, the forward and backward moving distances of the iron can be lengthened, which further improves usability of the iron.

The third space 15*c* is useful for expanding the area, which is visible while the iron is being moved backward and which neighbors and encompasses the rear end portion 6*b*. However, the third space 15*c* is not essential depending on the shape of the handle body 10.

Second Embodiment

Figure 7:
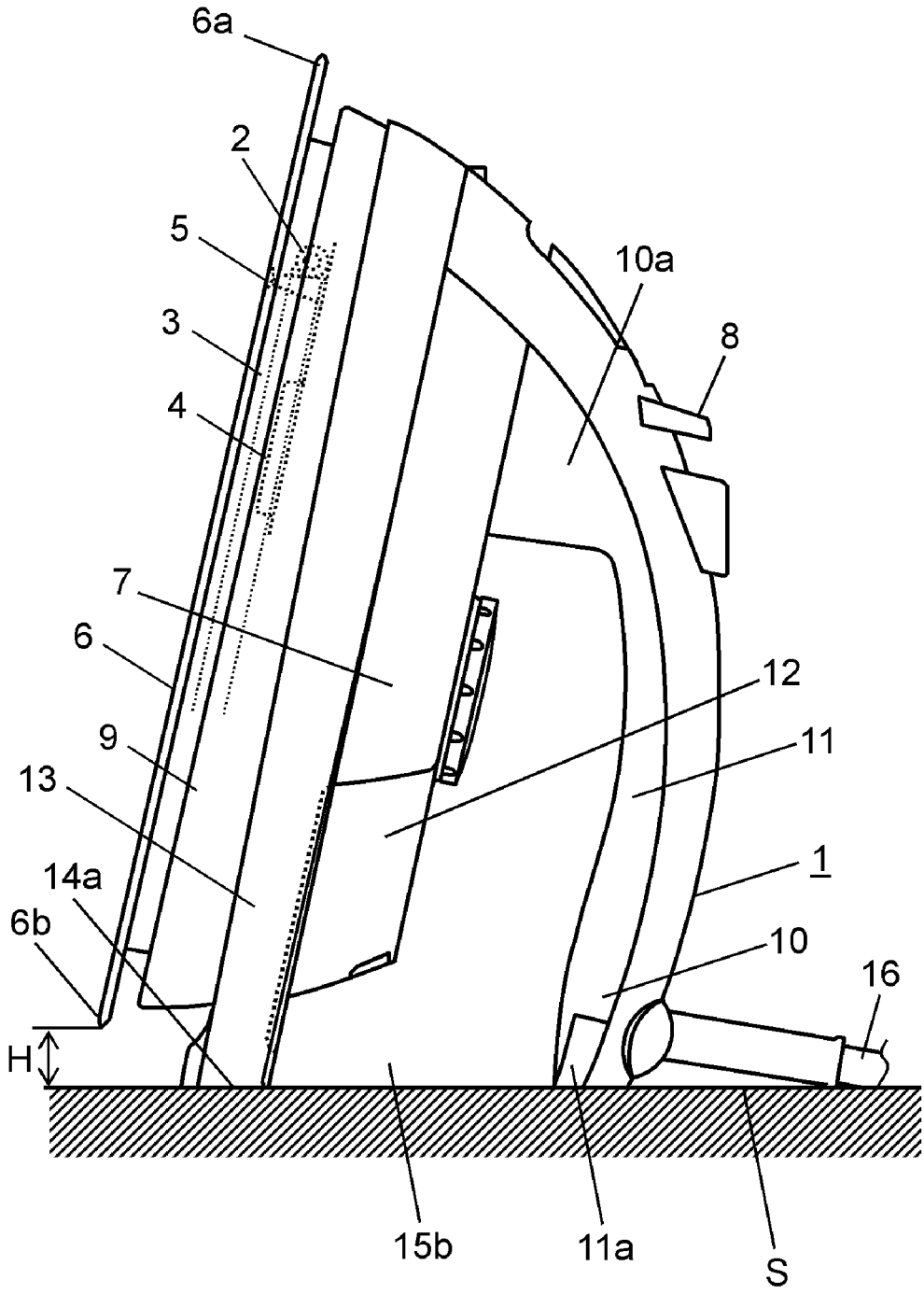
FIG. 7 is a side view of an iron in a self-standing state, according to a second embodiment.

FIG. 7 is a side view of an iron in a set state, according to a second embodiment of the present invention. In the present embodiment, the rear portion of the handle body 10 is not connected to the rear portion of the grip part 11, that is, the iron is in the form of a so-called "open handle". Since the other components in the present embodiment are the same as those of the first embodiment, they are denoted by the same reference numerals as those used in the first embodiment, and the detailed descriptions thereof are the same as those in the first embodiment.

In the above structure, the front portion of the handle body 10 is connected to the front portion of the grip part 11, and this connection (connection 10*a*) supports, on the handle body 10, the grip part 11 extending backward from the connection 10*a*. Accordingly, a structure in which the rear portion of the grip part 11 is not connected to the handle body 10 can be realized. As a result, the second space 15*b*, which is formed between the first support portion 14*a*, the second support portion 14*b*, and the third support portion 11*a* provided at the rear portion of the grip part 11, can be formed as a large open space. In this manner, the second space 15*b* can be formed efficiently. Consequently, the visibility of the area neighboring and encompassing the rear end portion 6*b*, which is obtained while the iron is being moved backward, is further enhanced. Thus, the usability of the iron at the time of moving the iron backward is improved.

Third Embodiment

Figure 8:
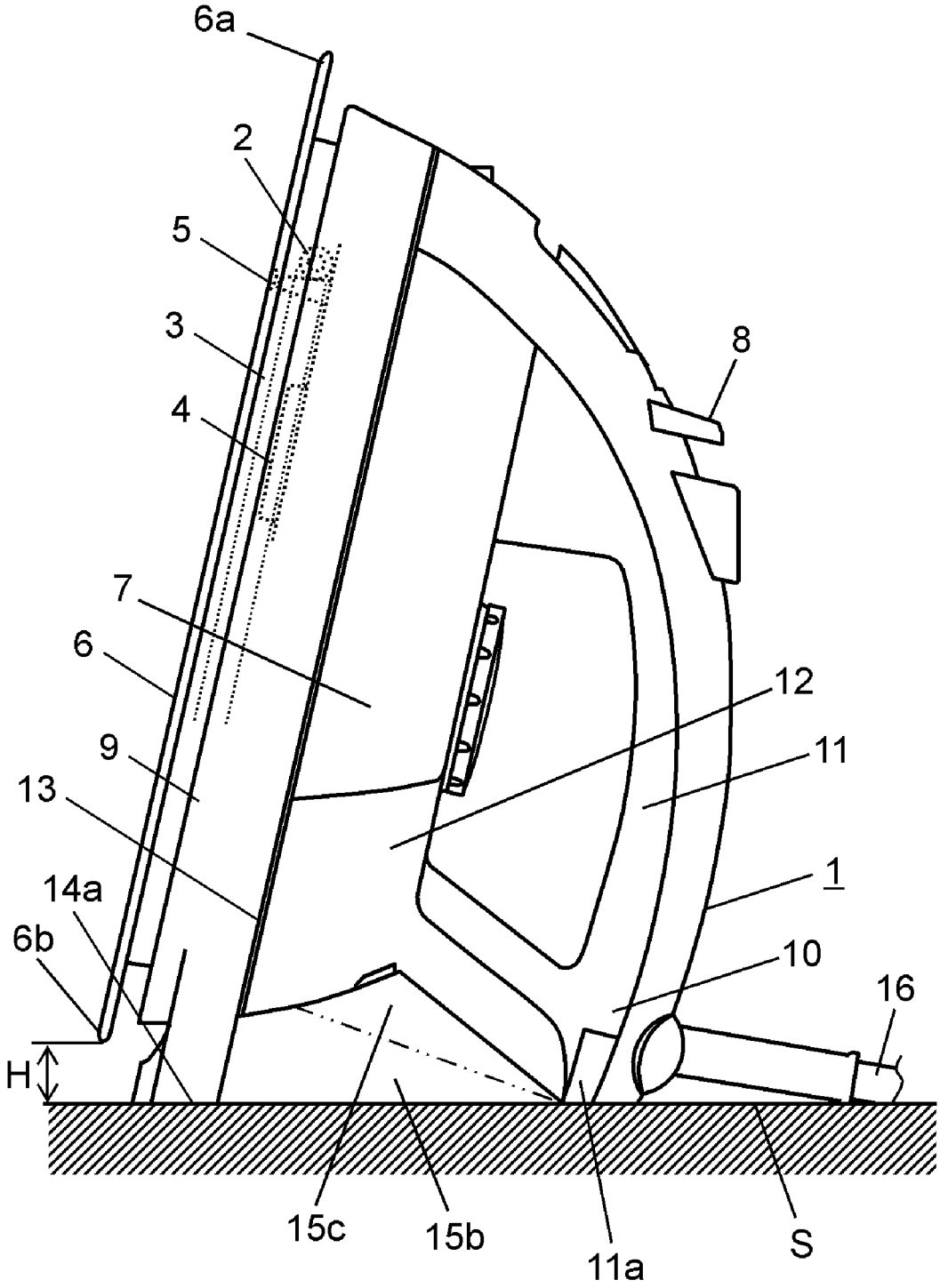
FIG. 8 is a side view of an iron in a self-standing state, according to a third embodiment.
Figure 9:
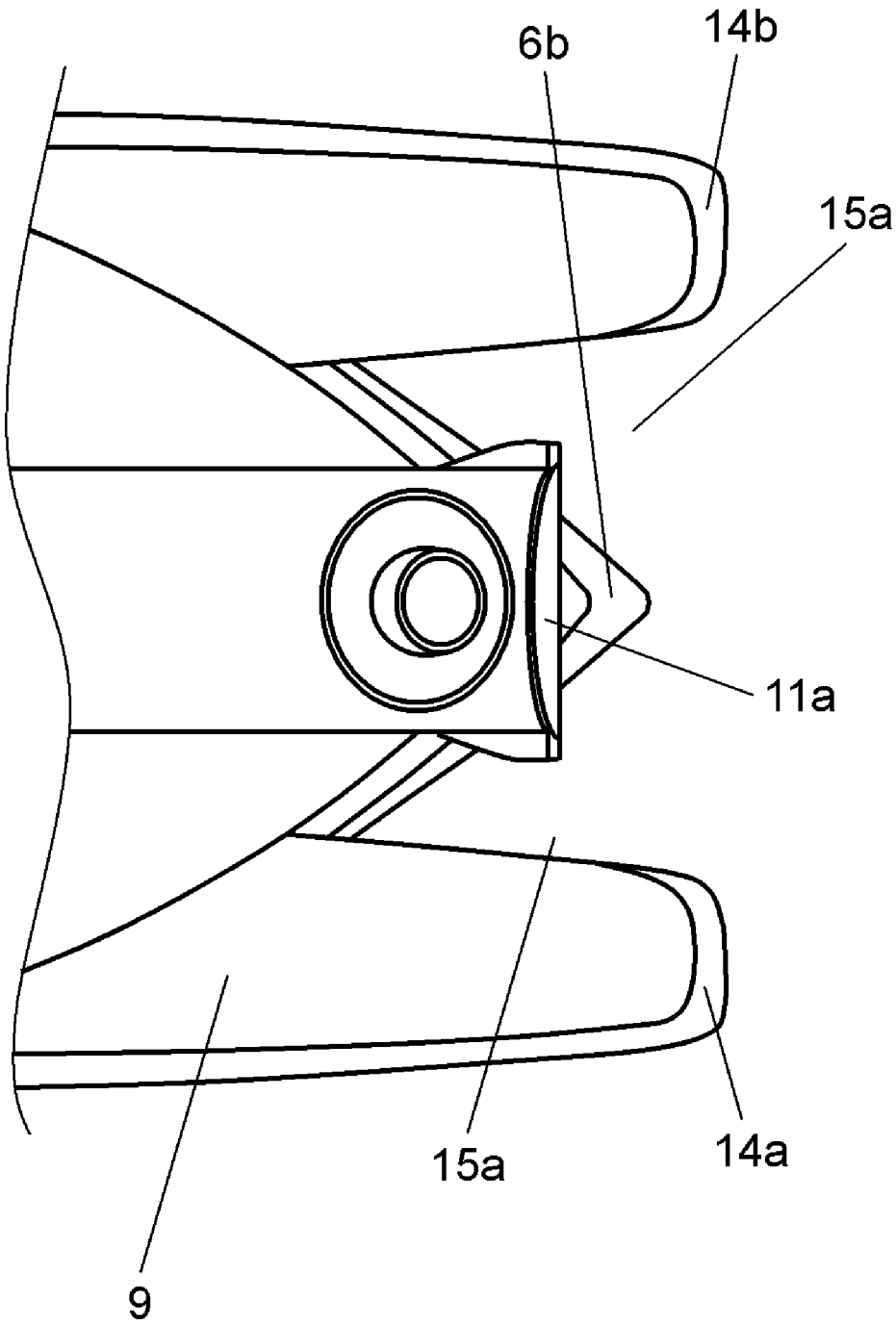
FIG. 9 is a top view showing an essential part of the iron.
Figure 10:
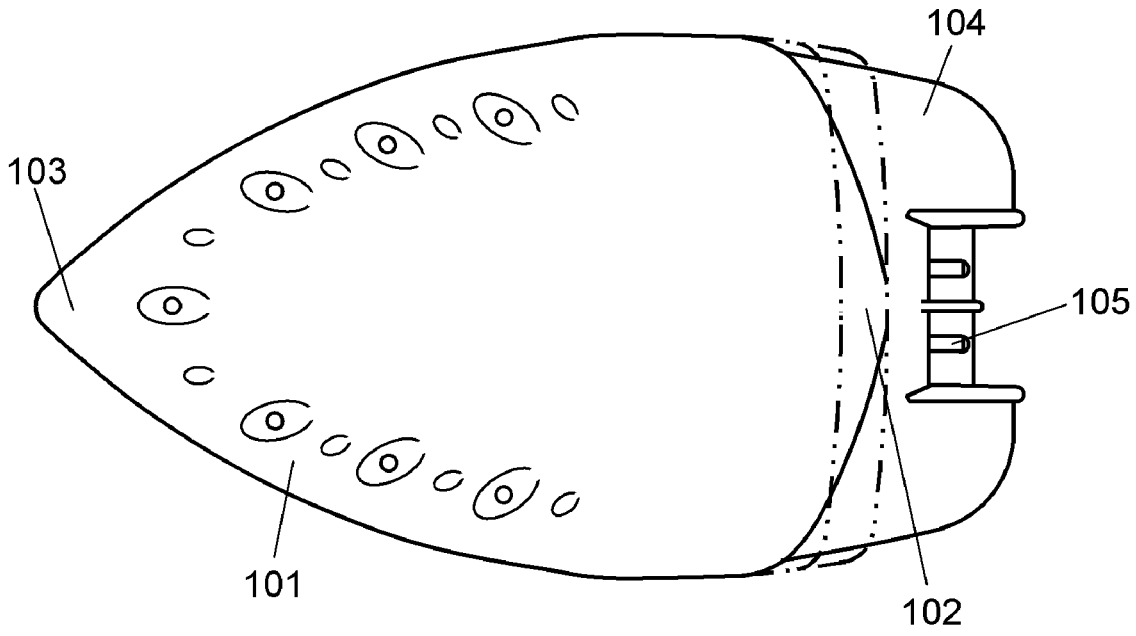
FIG. 10 (PRIOR ART)
FIG. 10 is a bottom view of a conventional iron.

FIG. 8 is a side view of an iron in a set state, according to a third embodiment. FIG. 9 is a top view showing an essential part of the iron. In the present embodiment, the first support portion 14*a* and the second support portion 14*b* are formed by protruding the rear portion of the thermal insulation board 9 backward. Since the other components in the present embodiment are the same as those of the first embodiment, they are denoted by the same reference numerals as those used in the first embodiment, and the detailed descriptions thereof are the same as those in the first embodiment.

In the above structure, at the rear portion of the thermal insulation board 9, which covers the top surface of the base 3 and which supports, on the top surface thereof, the handle body 10, the first support portion 14*a* and the second support portion 14*b* are formed so as to protrude backward. The first space 15*a* is formed between the first support portion 14*a* and the second support portion 14*b*.

As a result, a predetermined distance can be obtained between the third support portion 11*a* provided at the rear portion of the grip part 11 and each of the first and second support portions 14*a* and 14*b*. Accordingly, the visibility of the rear end portion 6*b* of the soleplate 6 can be obtained while the iron is being moved backward during ironing. Also, the iron main body 1 can be stably supported in a self-standing state by a simple and robust structure.

Note that in order to describe the manner of forming the first support portion 14*a* and the second support portion 14*b* on the iron main body 1, the above description describes a structure in which the support forming body 13 is attached to the iron main body 1, a structure in which the rear portion of the handle body 10 is protruded backward, and further, a structure in which the rear portion of the thermal insulation board 9 is protruded backward. However, the structure may be in any form as long as the visibility can be obtained while the iron is being moved backward and the iron main body 1 can be supported during a break in use of the iron.

Further, in each embodiment, the power cord 16 extends from the rear portion of the grip part 11. However, the power cord 16 may extend from the rear portion of the handle body 10.

Still further, in each embodiment, the iron is a corded iron having the power cord extending from the iron main body 1. However, the iron may be implemented on a cordless iron, of which the main body is placed on a stand for charging during a break in use of the iron and of which the main body is removed from the stand when the iron is used. Also in this case, the same advantageous effects as described above can be obtained.

Still further, although each embodiment describes a steam iron, the same advantageous effects as described above can be obtained also in irons without a steam generator.

Note that the iron can be implemented not only as each embodiment above but also as each embodiment above combined with a part of any other embodiment.

As described above, the iron according to the various embodiments allows ironing to be performed efficiently through both the forward and backward movements of the iron and provides improved usability of the iron when the iron is moved backward in the direction of the rear end portion. Therefore, the iron is useful as a home-use or professional-use iron.

While the invention has been described in detail, the foregoing description is in all aspects illustrative and not restrictive. It is understood that numerous other modifications and variations can be devised without departing from the scope of the invention.

What is claimed is:

1. An iron comprising:

a base heated by a heating element;

a soleplate provided on a bottom surface of the base, the soleplate having a front end portion and a rear end portion that are each formed in a pointed shape;

a thermal insulation board covering a top surface of the base;

a handle body provided above the thermal insulation board and having a grip part; and a support for supporting an iron main body to be in a self-standing state where the soleplate is substantially vertically disposed, wherein the support has a first support portion and a second support portion that are provided to both sides of the rear end portion of the soleplate so as to protrude backward from the iron main body, and has a third support portion provided at a rear portion of the grip part, and a space that allows the rear end portion of the soleplate to be visible is formed between the first and second support portions, wherein the first and second support portions are provided at both ends of a support forming body that is formed in a substantially U-shaped configuration along an outer side surface of the thermal insulation board.

2. The iron according to claim 1, wherein when the iron main body is supported by the support to be set in the self-standing state, the rear end portion of the soleplate is located in a position that is distanced upward, by a predetermined distance, from a setting surface on which the iron main body is set.

3. The iron according to claim 2, wherein the first and second support portions protrude further backward than the rear end portion of the soleplate.

4. The iron according to claim 1, wherein the first and second support portions are both distanced laterally from the rear end portion of the soleplate by respective distances that are set to be substantially equal to each other.

5. The iron according to claim 1, further comprising:

a vaporizing chamber, formed on the base, for generating steam; and a water tank, arranged above the thermal insulation board, for storing water to be supplied to the vaporizing chamber, wherein the support forming body covers a gap between the water tank and the thermal insulation board.

6. The iron according to claim 1, wherein the first and second support portions are formed as rod-like bodies that protrude backward from the iron main body such that when the iron main body is in a self-standing state, the soleplate is distanced upward from a setting surface, on which the iron main body is set, so as to have a predetermined height from the setting surface, a first space is formed between the first and second support portions that are the rod-like bodies, and a second space is formed between the first support portion, the second support portion, and a third support portion provided at the rear portion of the grip part.

7. The iron according to claim 1, further comprising:

a terminal embedded within a rear portion of the handle body; and a handle backing plate covering the terminal, wherein a central portion of the handle backing plate is recessed forward to form a third space.

8. The iron according to claim 1, wherein a rear portion of the handle body protrudes backward to form the first and second support portions.

9. The iron according to claim 1, wherein a rear portion of the thermal insulation board protrudes backward to form the first and second support portions.

10. An iron comprising:

a base heated by a heating element, the base having a front end portion and a rear end portion that are each formed in a pointed shape;

a handle body provided above the base and having a grip part; and a support for supporting an iron main body to be in a self-standing state where the base is offset from a set surface contacting the support, wherein the support has a first support portion and a second support portion that are provided to both sides of the rear end portion of the base so as to protrude backward from the iron main body, and has a third support portion provided at a rear portion of the grip part, and the first and second support portions are formed to provide a visible space to the rear end portion of the base and between the first and second support portions, wherein the first and second support portions are provided at both ends of a support forming body that is formed in a substantially U-shaped configuration along an outer side surface of a thermal insulation board covering a top surface of the base.

11. The iron according to claim 1, wherein the rear end portion of the soleplate includes only a single pointed shape that is disposed on a center portion of the soleplate.

12. The iron according to claim 1, wherein the rear end portion of the soleplate is visible between the first and second support portions.

* * * * *